United States Patent [19]

Taninbaum

[11] 4,230,015

[45] Oct. 28, 1980

[54] TAMBORINE

[76] Inventor: Richard L. Taninbaum, 218 W. Boston Post Rd., Mamaroneck, N.Y. 15043

[21] Appl. No.: 938,502

[22] Filed: Aug. 31, 1978

[51] Int. Cl.[3] ..... G10D 13/02

[52] U.S. Cl. ..... 84/418; 46/191; D17/22

[58] Field of Search ..... 84/418; 46/189–191, 46/193; D17/22, 24

[56] References Cited

U.S. PATENT DOCUMENTS

| | | | |
|---|---|---|---|
| 587,561 | 8/1897 | Sherman | 84/418 X |
| 3,481,239 | 12/1969 | Blumenfeld | 84/418 |
| 3,675,528 | 7/1972 | Brick | 84/418 |

*Primary Examiner*—Lawrence R. Franklin

*Attorney, Agent, or Firm*—Barry L. Haley; Eugene F. Malin; Philip R. Wadsworth

[57] ABSTRACT

An improved tamborine which includes an arcuate frame having a plurality of jingle members affixed to the frame, the frame including a grasping portion disposed at or near the center of gravity of the rim such that the tamborine may be comfortably held for long periods of time. The handle may include a padded portion and may be disposed close to the geometrical center of the rim, as desired.

2 Claims, 2 Drawing Figures

TAMBORINE

BACKGROUND OF THE INVENTION

This invention relates generally to a "headless" tamborine, which is a percussion musical instrument used in contemporary rock music. Conventional tamborines are circular in shape and include sounding elements that essentially jingle connected in slots around the circular frame.

One drawback while playing the tamborine is that the hand and arm can become tired because the instrument is conventionally grasped at one edge of the frame not near the center of gravity. Thus, a large moment of force is created by holding the frame on an edge which causes discomfort to the user. Grasping the instrument can also be awkward because of the shape of the frame in comparison to the grasping hand.

The present invention overcomes the drawbacks found in the prior art while not diminishing the acoustical qualities of the device by providing a tamborine that includes a handle disposed near or at the center of gravity which increases comfort during use, reducing fatigue of the hand or arm, increases the grasping ability for improved coordination during playing.

BRIEF DESCRIPTION OF THE INVENTION

A musical instrument, such as a tamborine, which includes a rigid, partially circular frame and a plurality of sounding elements such as jingles disposed at predetermined locations around the frame for creating a particular percussion sound. The frame includes a chord-like segment sized for manual grasping disposed at or near the center of gravity of the frame, integrally formed with the frame, functioning as a handle.

The jingles are connected in a conventional way about the frame. The handle is positioned to greatly reduce any moments of force such that the instrument feels balanced when held.

To operate the tamborine, it is grasped about the handle and moved manually in a conventional manner. The construction of the rim and the spacing of the sounding elements allows for and provides a conventional sound to the device in spite of the alteration for the improved handle position. The handle position does allow for greater dexterity and movement of the device for increasing the tonal qualities available.

Frame configurations other than circular could be employed as long as the handle is disposed near or at the center of gravity.

The device may be constructed of conventional materials for the contemporary acoustical tonal qualities desired. The acoustical elements employed (such as jingles) are conventional in construction and do not alone form a part of the invention.

It is an object of this invention to provide an improved tamborine which allows one to more readily and easily grasp the tamborine.

It is another object of this invention to provide a tamborine which allows for improved handling characteristics for greater dexterity while not diminishing the tonal characteristics of the musical instrument.

But still yet another object of this invention is to provide an improved tamborine which requires less muscular strength thereby reducing fatigue for its operation and actuation.

In accordance with these and other objects which will be apparent hereinafter, the instant invention will now be described with particular reference to the accompanying drawings.

PREFERRED EMBODIMENT OF THE INVENTION

Figure 1:
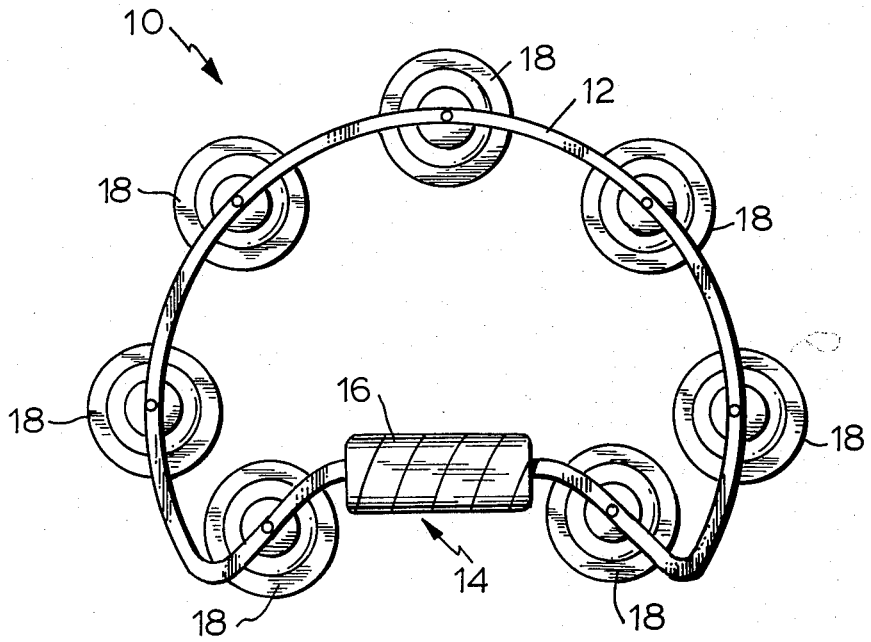
FIG. 1 is a top plan view of the instant invention.
Figure 2:
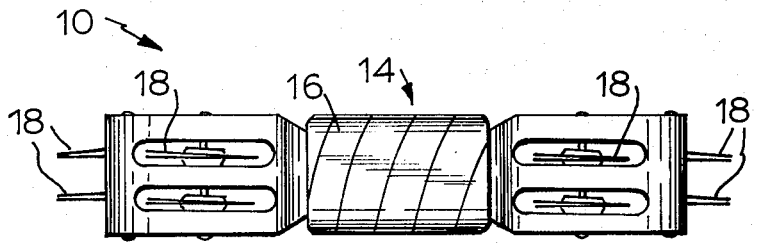
FIG. 2 is a side elevational view of the instant invention.

Referring now to the drawings and especially FIG. 1, the instant invention is shown generally at 10 comprised of a partially circular frame 12 having a handle segment 14 which includes a suitable padding material 16 which allows the instrument to be comfortably grasped. The handle segment 14 is geometrically similar to a chord of a circle and is disposed near the frame center of gravity, when considering the frame as a whole. A plurality of sounding elements such as jingles 18 are disposed and connected to the rim in a conventional manner.

In operation, the device is grasped across the handle portion and may be moved in a conventional manner.

Note that the placement of the handle greatly reduces the conventional moment forces which exist when trying to hold a completely circular tamborine along the edge.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved tamborine, comprising:

a rigid, enclosed jingle supporting frame;

a plurality of pairs of percussion jingles connected in pairs to said frame at predetermined locations about a first segment of said frame; and a handle for manually grasping said frame, connected to a second segment of said frame, said second segment bearing said handle being disposed closer to the said center of gravity of said device than said first segment said first segment of said frame being arcuate in shape, and said second segment including radial, inwardly disposed portions and a handle bearing portion that is substantially parallel to a chord formed between the ends of said arcuate first segment.

2. An improved tamborine as in claim 1, wherein:

said handle is disposed on said second frame segment at the center of gravity of the device.

* * * * *